US008100694B2

(12) United States Patent
Portoghese et al.

(10) Patent No.: US 8,100,694 B2
(45) Date of Patent: Jan. 24, 2012

(54) INFRARED AIMPOINT DETECTION SYSTEM

(75) Inventors: Rocco Portoghese, Orlando, FL (US); Paul Geoffrey Barber, Orlando, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1261 days.

(21) Appl. No.: 11/820,037

(22) Filed: Jun. 11, 2007

(65) Prior Publication Data

US 2011/0003269 A1 Jan. 6, 2011

(51) Int. Cl.
*F41G 3/26* (2006.01)

(52) U.S. Cl. ..... 434/22; 434/21

(58) Field of Classification Search ..... 434/19–22
See application file for complete search history.

(56) References Cited

U.S. PATENT DOCUMENTS 2,472,136 A * 6/1949 Whitlock ..... 89/28.05
3,588,237 A * 6/1971 Aldrich ..... 352/39
3,633,285 A * 1/1972 Sensney ..... 434/22
3,657,826 A * 4/1972 Marshall et al. ..... 434/22
3,847,396 A * 11/1974 Ashford ..... 434/16
3,849,910 A * 11/1974 Greenly ..... 434/22
3,882,496 A * 5/1975 Lewis et al. ..... 342/54
3,888,022 A * 6/1975 Pardes et al. ..... 434/20
3,938,262 A * 2/1976 Dye et al. ..... 434/21
3,964,178 A * 6/1976 Marshall et al. ..... 434/20
4,222,564 A * 9/1980 Allen et al. ..... 273/369
4,223,454 A * 9/1980 Mohon et al. ..... 434/20
4,349,337 A * 9/1982 Pardes ..... 434/20
4,398,722 A * 8/1983 Morris et al. ..... 463/51
4,662,845 A * 5/1987 Gallagher et al. ..... 434/22
4,678,437 A * 7/1987 Scott et al. ..... 434/21
4,923,402 A * 5/1990 Marshall et al. ..... 434/22
4,943,239 A * 7/1990 Koslin ..... 434/353
4,958,284 A * 9/1990 Bishop et al. ..... 434/353
4,963,096 A * 10/1990 Khattak et al. ..... 434/21
5,011,413 A * 4/1991 Ferris et al. ..... 434/358
5,095,433 A * 3/1992 Botarelli et al. ..... 273/372
5,194,007 A * 3/1993 Marshall et al. ..... 434/21
5,213,503 A * 5/1993 Marshall et al. ..... 434/22
5,215,465 A 6/1993 Marshall et al.
5,591,032 A * 1/1997 Powell et al. ..... 434/22
5,605,461 A * 2/1997 Seeton ..... 434/21
5,716,216 A * 2/1998 O'Loughlin et al. ..... 434/22
5,788,500 A * 8/1998 Gerber ..... 434/22
5,816,817 A * 10/1998 Tsang et al. ..... 434/22

(Continued)

OTHER PUBLICATIONS

Cybermike. "Multivibrators" http://web.archive.org/web/20020825134830/http://www.cybermike.net/reference/liec_boo.*

*Primary Examiner* — Robert J Utama
(74) *Attorney, Agent, or Firm* — Eliot Abolafia; Mark D. Kelly

(57) ABSTRACT

An exemplary embodiment of the invention relates to an infrared weapon aimpoint and triggering detection system that includes an IRED that is modulated in two modes for training and evaluating first responders who are required to enter buildings and raid houses. The IRED mode is either an aiming mode or a triggered mode. The triggered mode is initiated for a short period when the weapon is fired as sensed by a recoil sensing mechanism. An IRED detector and controller sense and process the signal, and may provide output to an instructor, evaluator or a target controller to control the behavior of a target.

12 Claims, 4 Drawing Sheets

U.S. PATENT DOCUMENTS 5,870,741 A * 2/1999 Kawabe et al. ..... 1/1
6,173,154 B1 * 1/2001 Kucinski et al. ..... 434/359
6,322,365 B1 * 11/2001 Shechter et al. ..... 434/21
6,450,816 B1 * 9/2002 Gerber ..... 434/11
6,530,782 B2 * 3/2003 Fouse et al. ..... 434/19
7,107,547 B2 * 9/2006 Cule et al. ..... 715/810
7,687,751 B2 * 3/2010 Page ..... 244/3.1
7,846,028 B2 * 12/2010 Small et al. ..... 463/51
2002/0064761 A1 * 5/2002 Ripingill et al. ..... 434/19
2002/0134000 A1 * 9/2002 Varshneya et al. ..... 42/115
2003/0180692 A1 * 9/2003 Skala et al. ..... 434/22
2003/0224340 A1 * 12/2003 Housman et al. ..... 434/353
2006/0073438 A1 4/2006 Page
2006/0291723 A1 * 12/2006 Koyama et al. ..... 382/181
2007/0238073 A1 * 10/2007 Portoghese et al. ..... 434/21

* cited by examiner

INFRARED AIMPOINT DETECTION SYSTEM

BACKGROUND OF THE INVENTION

1. Field of the Invention

This invention relates generally to aimpoint detection systems and more particularly to infrared aimpoint detection systems having recoil sensors and modulated infrared emitting diodes.

2. Description of the Related Art

In the field of law enforcement training and performance evaluation, one goal is to determine a trainee's or evaluatee's (hereafter, "trainee") intent to aim at a target rather than the specific point on the target at which he is aiming. The training goal correlates well with actual behavior in the field because law enforcement personnel will almost never be aiming directly at the small active area of an aimpoint detector which is placed on or near a target. In particular, this environment is encountered in raid houses, mock-up rooms or buildings with physical targets for trainees to engage. Therefore, some spread of the infrared beam is desirable and, at close range, necessary to ensure reliable emulation. Furthermore, in a training environment interactive targets may be made to sense that they are being "covered" or "engaged" and may be programmed to react by simulating predicted behaviors.

Monitoring both the historic aimpoint (for example, aimpoint track) during a training event with respect to the target, and the aimpoint with respect to the target at the time that a weapon is triggered provides useful feedback. Measures of performance such as reaction time, judgment and accuracy are inferred by both the historic aimpoint and the firing of the weapon.

During training and evaluation, there is a substantial advantage when a trainee is able to use his or her service weapon, and not a simulated, replacement weapon. Factors such as weapon feel and performance, etc. affect a trainee's behavior and performance in actual situations, and should incorporate fidelity to the maximum extent practicable. In recognition of this advantage, systems such as SIMUNITION® from SNC Technologies, Inc. and AIRMUNITION® from Aimmunition International, B.V. are commonly available and widely used in training. Such systems change the trainee's service weapon barrel for a training-only barrel, allowing the service weapon to fire non-lethal training munitions.

There are many different sensors that are used to determine when a weapon is triggered. The non-lethal munitions such as SIMUNITION® and AIRMUNITION® produce recoil thereby providing a suitable environment to utilize an inertia or shock sensor (herein, "recoil sensor") to determine when the weapon is fired. In this specification and claims the terms "fired" and "triggered" are used interchangeably.

It is well-known that most modern service weapons include or are capable of including a commercially available mount on the weapon. For example, commercially available mounts are manufactured by the Surefire Corporation.

Therefore, there is a need for an aimpoint detection system that can be used on different models of service weapons without the need for complex reconfiguration and time delay.

There is a further need for an aimpoint detection system that is particularly suitable for use with a service weapon that produces recoil.

There is a still further need for a cost effective aimpoint detection system that can be mounted with commercially available weapon mounts.

BRIEF SUMMARY OF THE INVENTION

It is an object of the invention to sense when a weapon is aimed in the direction of a target.

It is yet another object of the invention to capture the aimpoint at the moment of weapon firing.

It is a further object of the invention to be capable of use on any service weapon having a standard type of mount.

It is a yet further object of the invention to be capable of use on different service weapons without the need for complex setup and time delay.

In order to accomplish the above objects, in accordance with a first aspect of the present invention there is provided an aiming and triggering detection system that includes a weapon with a bore and an infrared emitting diode substantially aligned with the weapon bore, a target, an infrared detector controller, and an infrared detector positioned within a zone of the target for determining whether the weapon is aimed within the zone of the target, or triggered within the zone of the target. The system comprises a sensor responsive to triggering the weapon. In addition, an aiming-triggering mode selector having a seal-in control is responsive to the sensor for selecting either an aiming mode or a trigger mode. The seal-in control is initiated upon the triggering of the weapon as sensed by the sensor. A modulator is included that has at least two output modulation signals for modulating the infrared emitting diode in at least two modes as the modulator is responsive to the selector. The infrared emitting diode has an aiming modulating mode for transmitting infrared output to the infrared detector, and a triggering modulating mode for transmitting infrared output to the infrared detector when the weapon has been triggered, the mode of the infrared emitting diode being controlled by the modulator. The infrared detector is sensitive to the wavelengths emitted by the infrared emitting diode when the light from the infrared emitting diode enters the detector. The infrared detector controller differentiates between the modes of modulation detected by the infrared detector.

In another aspect of the invention an aiming and triggering emission module for mounting the module on a weapon is disclosed. The aspect comprises a recoil sensor for sensing the recoil of the weapon. An aiming-triggering mode selector having a seal-in control is responsive to the recoil sensor for selecting either of an aiming mode or a triggered mode. The seal-in control is initiated upon the recoil of the weapon as sensed by the sensor. A modulator has at least two output modulation modes, with the modulator being responsive to the selector. An infrared emitting diode has an aiming modulating mode and a triggering modulating mode when the weapon has been triggered. The mode of the infrared emitting diode is controlled by the modulator. A power supply is connected to the modulator and to the infrared emitting diode for powering the modulator and the diode. Finally, the power supply, the diode, the modulator, the selector, and sensor are all housed within the module.

In yet another aspect of the invention, a combination is disclosed consisting of an adjustable recoil sensor for sensing the recoil of the weapon; an aiming-triggering mode selector having a seal-in control, the selector being responsive to the recoil sensor for selecting either of an aiming mode or a trigger mode, the seal-in control being initiated upon the recoil of the weapon; a modulator having at least two output modulation modes, the modulator being responsive to the selector; an infrared emitting diode having an aiming modulating mode, and a triggering modulating mode when the weapon has been triggered, the mode of the infrared emitting diode being controlled by the modulator; and a power supply connected to the modulator and to the infrared emitting diode for powering the modulator and the diode.

In still another aspect of the invention an assembly for insertion in an aiming and triggering infrared emission module having battery power is disclosed. The purpose of the assembly is to emit infrared light that is responsive to recoil by controlling the modulation of infrared light when the module is mounted on a weapon for transmitting an aiming mode or a triggered mode to a infrared detector. The aspect comprises a power board having a spring attached to an outer surface of the power board, a pin attached to an opposite surface of the power board and electrically connected to the spring for conducting electricity from the battery. An oscillator board, is attached to the pin, and axially positioned substantially parallel to the power board. The pin extends through the oscillator board for conducting electricity. A drive board is attached to the pin, and axially positioned substantially parallel to the oscillator board. The pin extends through the oscillator board for conducting electricity. An LED board comprises an IRED mounted to an outer surface of the LED board. The LED board is attached to the pin, and axially positioned substantially parallel to the drive board. The pin conducts electricity for powering the IRED. A recoil sensor is positioned between the oscillator board and the drive board. The pin is in electrical communication with the drive board for changing electrical state.

These and other features and advantages of the present invention may be better understood by considering the following detailed description of certain preferred embodiments. In the course of this description, reference will frequently be made to the attached drawings.

DETAILED DESCRIPTION OF THE INVENTION

In the following detailed description of the preferred embodiment, reference is made to the accompanying drawings in which is shown by way of illustration a specific embodiment whereby the invention may be practiced. It is to be understood that other embodiments may be utilized and changes may be made without departing from the scope of the present invention.

Figure 1:
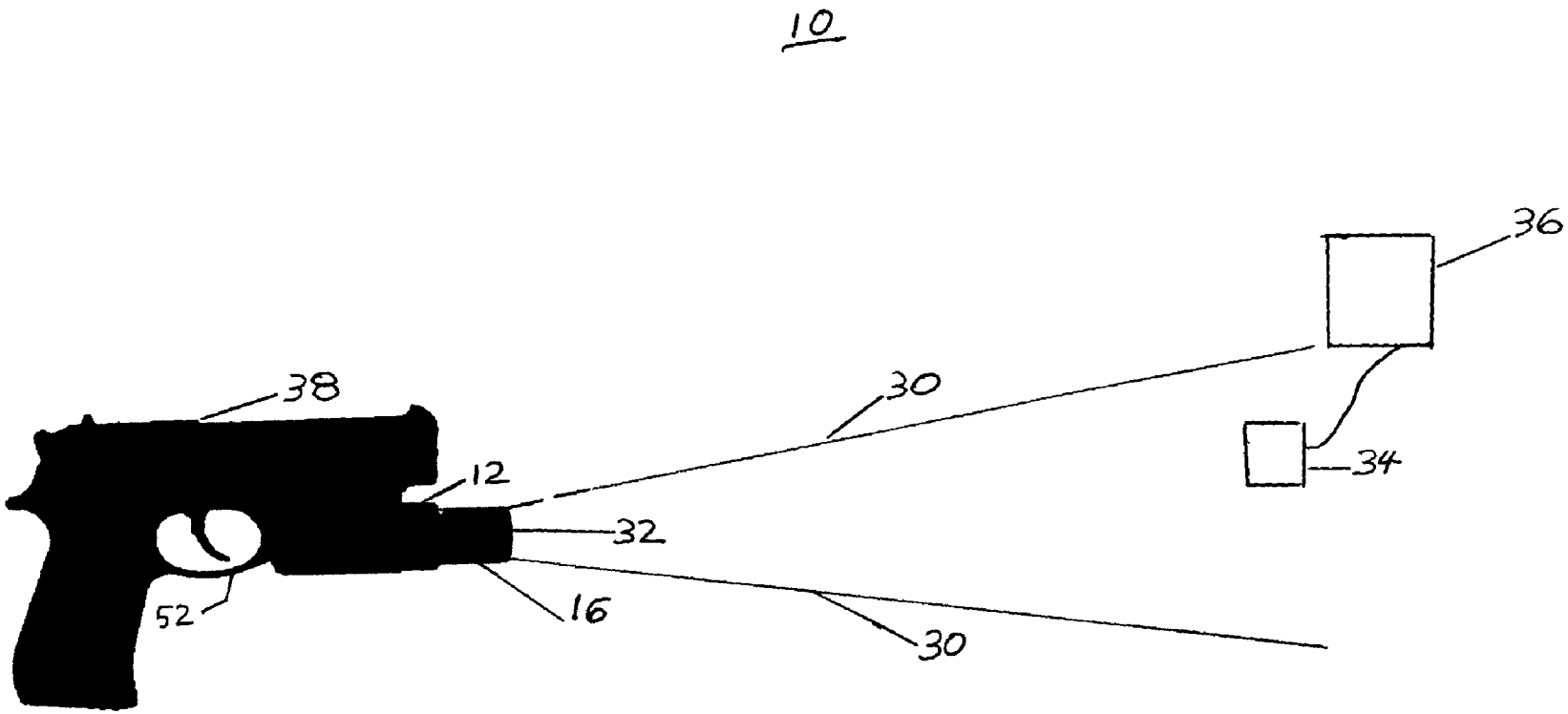
FIG. 1 is a perspective view illustrating an exemplary infrared aimpoint detection system of the present embodiment.
Figure 2A:
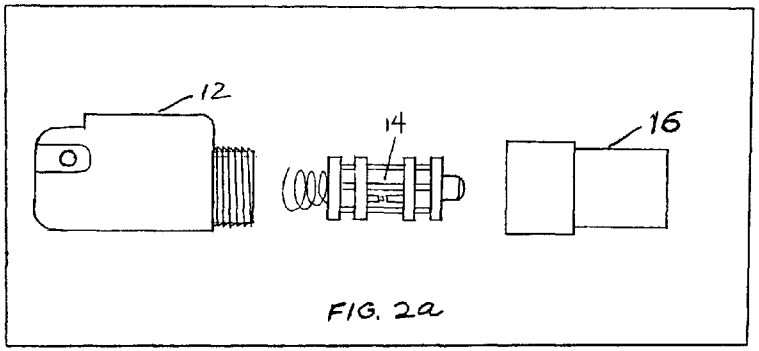
FIG. 2*a* is an exploded sectional view illustrating components for a weapon module of the exemplary embodiment.

Referring to FIG. 1, and FIGS. 2*a,b* and *c* an exemplary embodiment of an aimpoint detection system is shown generally at 10. A weapon module 12 comprises an integrated IRED control assembly 14, battery power supply (not shown) and a lens retainer 16. The assembly 14 includes an infrared emitting diode (IRED) 18, a recoil sensor 22, a spring 24 with a contact 26, a modulator 28 and supporting structure and electronic circuitry 29. The IRED emits an infrared light projection cone (beam) 30 through a lens 32 positioned within the lens retainer 16. The light cone illuminates an infrared detector 34 when the infrared detector is within the IRED's projection cone.

The recoil sensor 22 controls the modulator 28 that energizes the IRED 18 in either of two modulating frequencies or modes, herein defined as the aiming mode and the triggered mode. The output of the infrared detector is sensed by an infrared detection board (IRDB) 36 capable of distinguishing the modulation mode of the IRED. It is to be appreciated that in the exemplary embodiment, the IRED, modulator, and a battery power supply are housed within the module (herein, "the weapon module") 12 that mounts on a weapon 38 so that the module can be used with different weapons providing rapid changeover.

The weapon 38 is preferably the service weapon normally used by the trainee, for example but without limitation, an M9 pistol. In the illustrated embodiment, the service weapon is modified to use non-lethal munitions such as SIMUNITION® and AIRMUNITION® to produce recoil thereby providing a suitable environment for the recoil sensor to sense when the weapon is triggered. However, it is to be appreciated that a physical hit detection system may be used along with the infrared aimpoint detection system where more complex target behavior is being simulated since the triggered signal, preferably initiated from recoil, will be produced by the triggering event in either case.

Figure 3:
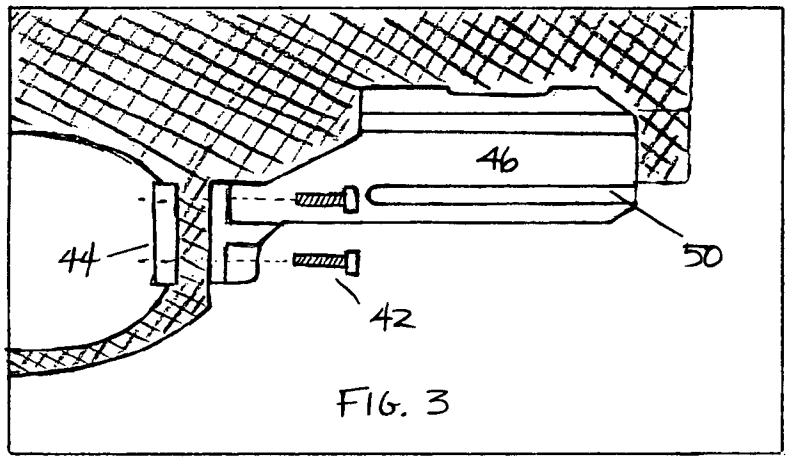
FIG. 3 is an exemplary illustration of an adaptor and hardware for the present embodiment.

Referring to FIG. 3, the mounting system is illustrated at 40 along with mounting hardware consisting of four screws 42, a plate 44 for mounting the weapon module with an adapter 46 for an M9 pistol. The weapon module 12 (see FIG. 1) is a standard series tactical flashlight with an adoptive mount sold under the name Nitrolon® made by SureFire, LLC located in Fountain Valley, Calif. The weapon module is threaded at one end to mate with the lens retainer 16. The lens retainer houses a lens 32 for narrowing the infrared beam. As is well-known in the art, the lens can comprise one or more lenses to control the aberration and diffusion of the infrared beam.

Referring to FIG. 1 and FIG. 3 the adapter 46 surface forms rails 50 for ease of mounting the weapon module 12. The adaptor is attached to the weapon's trigger guard 52 with the mounting plate 44 and the four screws 42. The rails 50 allow the weapon module to be mounted or removed. A locking mechanism (not shown) is provided in the adaptor 46 to retain the weapon module in position. A release (not shown) on the adapter connects with the locking mechanism to unlock the mechanism so the weapon module can be removed. In the exemplary embodiment, the weapon module is attached by sliding the module onto the rails and manually applying pressure until the module locks in place. The module is removed by pushing upward on a release and sliding the weapon module from the adapter.

It is to be appreciated that a wide variety of adapters are available for mounting the weapon module. Furthermore, many weapons now come with suitable integral mounting rails, obviating the need for the adapter mount. Although the mount is shown positioned below the weapon barrel, it is to be further appreciated that the weapon module can be mounted on any surface of the weapon depending on the location of the standard mount or adapter.

Figure 2C:
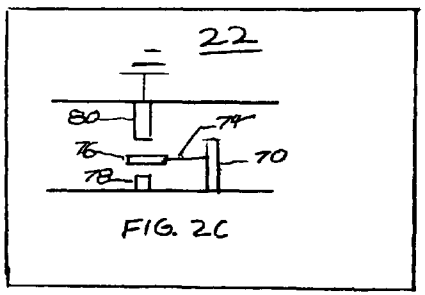
FIG. 2*c* is a sectional view of a recoil sensor the present embodiment.
Figure 2B:
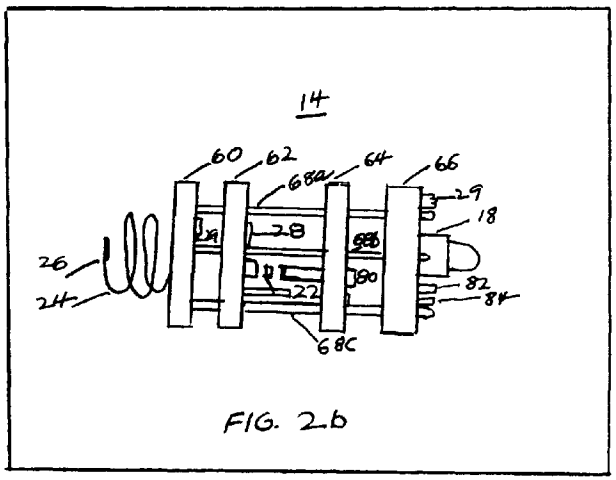
FIG. 2*b* is a sectional view of an IRED assembly the present embodiment.
Figure 4:
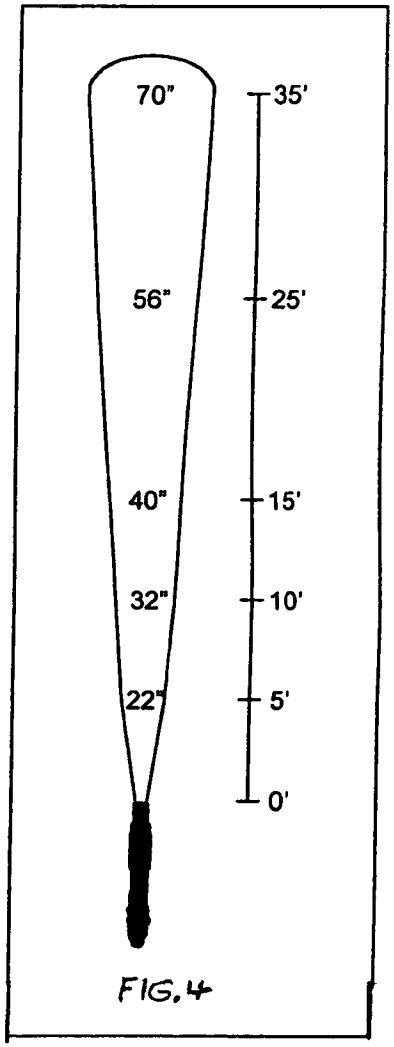
FIG. 4 is a graph showing an exemplary cone of projection.

Referring again to FIG. 2*a*, FIG. 2*b*, and FIG. 2*c*, the IRED control assembly 14 is illustrated. The IRED control assembly replaces the standard flashlight bulb and reflector. The assembly also comprises the recoil sensor 22, modulation and drive circuitry 28, and the supporting structure and electrical circuitry 28 to draw power from the weapon module's batteries.

The IRED control assembly consists of four circular printed circuit boards; a Power Board 60, an Oscillator Board 62, a Drive Board 64, and an LED Board 66. The Power Board mounts two springs 24 to contact and bring power from the weapon module's battery contacts (not shown) to the IRED control assembly when the assembly is installed in the weapon module 12 and the lens retainer 16 is in place. Power is conducted to the circuit boards 62, 64, 66 through three conductive posts 68*a,b,c* that also act as the main support structure of the IRED control assembly.

The Oscillator Board 62 provides the structure to mount the circuitry required to generate the control signals for the two modulation frequencies, "aiming" and "triggered", as well as support for the recoil sensor riser 70. The recoil sensor 72 consists of a thin arm 74 with a weighted end 76 suspended by the riser 70 in the space between the oscillator board 62 and drive board 64. Two screws 78, 80 complete the recoil sensor structure. The sensor riser 70, arm 74, weighted end 76 and screws 78, 80 are constructed from brass although other conducting materials are within the contemplation of the invention. As is well known in the art, the riser and arm are "pulled up" to TTL voltage levels. The screw 78 mounted in the Oscillator Board is not electrically connected and serves to limit the recoil sensor arm downward motion to prevent bending during a recoil event. The screw 80 mounted in the Drive Board is electrically connected to ground. During a recoil event of sufficient intensity, the sensor arm will momentarily contact the upper screw, bringing the recoil sensor to ground. In the illustrated embodiment, sensitivity is adjusted by bending the arm 74 to adjust the weighted end's position between the two screws. Moving the contact surface toward screw 78 will decrease the recoil sensor's sensitivity. Moving the contact surface toward screw 80 will increase sensitivity. The preferred position is equidistant from each screw for adjustment flexibility although adjustments are within the contemplation of the embodiment. It is to be appreciated that the use of other sensors that sense triggering are also within the contemplation of the invention.

The drive board 64 mounts the circuitry to sense and process the recoil sensor's output and selects the appropriate IRED modulation mode. It is within the contemplation that the selector function can be performed either mechanically, for example with an electro-mechanical contact, or electrically, for example with programmable logic components. It is important that the seal-in time period of the modulator that corresponds to the triggered state is of a sufficient duration so that the IRED detector 34 and control board 36 are able to sense, distinguish and process the aiming and triggered modes. In the illustrated embodiment, the seal-in was adjusted between 0.1 to 0.5 seconds and preferably set at 0.25 seconds.

The LED Board 66 mounts the IRED 18 along with the high-current circuits required to drive the IRED at the particular frequencies of modulation commanded by the output from the drive board 64. The IRED 18 is an OptoDiode Corporation OD-50L, a commercial off-the-shelf infrared emitting diode with an integral lens. Two status LEDs, 82, 84 are attached to the LED board. The LED's indicate respectively "powered" 82 and "triggered" 84, to monitor the IRED control assembly's operation.

The IRED lens collects and focuses the infrared rays in order to maximize the intensity of the beam, to extend beam effective range, and minimize beam dispersion in order to illuminate the target with infrared. It is important that the IRED detector 34 is illuminated only when the weapon in pointed in the direction of the target. In the illustrated embodiment a second lens 32 is included in the lens retainer 16 for further focusing the light from the IRED.

Figure 5:
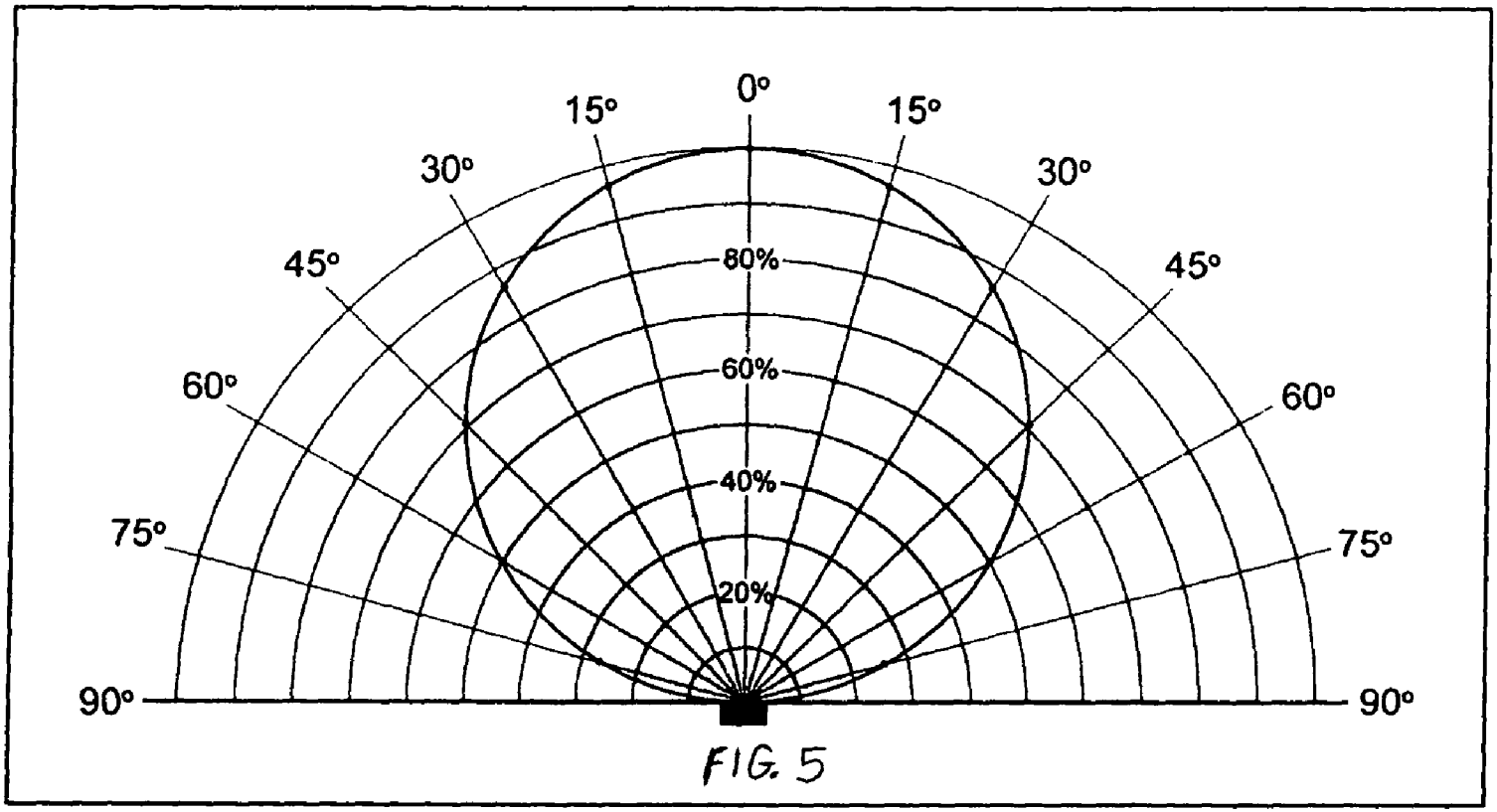
FIG. 5 is a graph showing infrared detector sensitivity as a percentage of weapon module effective range vs. infrared beam angle of incidence.

Referring again to FIG. 5, the effective cone of projection 30 resulting from the IRED and lens combination is illustrated. The normal effective range is 35 feet depending upon initial and ambient conditions, for example the battery charge, the orientation of the sensor, airborne particulates, etc. The cone is symmetrical in the horizontal and vertical axis, producing rotational symmetry, and preferably aligned to the weapon barrel to result in a symmetrical pattern centered on the weapon aimpoint.

If the IRED's output is narrowly focused, the lens 32 is not required as the illumination will provide the required performance characteristics, such as illustrated by the cone of projection 30. This is a result of the performance properties of the IRED wherein the spread of the beam, output intensity of the IRED, and sensitivity of the detector's sensor must cooperate to define the characteristics of the invention, being the accuracy and reliability of the weapon aimpoint determination.

Referring again to FIG. 1, the infrared detector 34 is an ODD-95W-ISOL, a standard off-the-shelf detector from OptoDiode Corporation. It is specifically selected to be highly sensitive to the wavelength of light emitted by the OD-50L IRED 18 mounted in the weapon module 12. The detector's response time is sufficiently fast to distinguish between the two frequencies of modulation emitted by the IRED 18. It is within the contemplation of this embodiment to use other detectors, so long as they are at least as sensitive to the wavelength emitted by the particular IRED. The frequencies of modulation employed are such that they are easily accommodated by the response times of all practical infrared detectors known to those of average skill in the art.

The infrared detector 34 is mounted on the target or may alternately be near the target depending upon the training scenario that is chosen. The output of the infrared detector is read by the Infrared Detect Board (IRDB) 36. In the illustrated embodiment, the IRDB distinguishes between the two frequencies of IRED modulation and present the results as two TTL-level outputs. The output is read by whatever system or intelligence, for example, a computer controlling a servomechanism, which is desirable to control the target's behavior and/or record the trainee's actions.

Referring to FIG. 6, the infrared detector sensitivity is plotted as a percentage of the IRED's normal effective range vs. the angle of incidence of the infrared light beam. It is to be appreciated that the detector field of view is generally wide, though sensitivity drops off as the infrared is transmitted towards the edges of the sensor's field of view It is within the contemplation of the present embodiment to include multiple infrared detectors on or near each target. In a situation where trainees approach a target from multiple directions, multiple sensors may be used to sense all angles. Alternatively, if it is required that a target should be responsive at ranges greater than the IRED's typical effective range, for example, the target is at the end of a long corridor, then multiple sensors can be used to sense the same field of view. The additional sensors will increase the IRED's effective range by allowing the target to collect more infrared energy. It has been determined through experimentation that three sensors that sense the same field of view provide a detection range exceeding sixty feet.

When a physical hit detection system is incorporated in addition to the infrared aimpoint detection system, the target's behavior may be set so that the detection of an infrared "weapon fired" signal without a corresponding physical hit detection (the trainee fired but missed) will be used to alter the target's behavior. The target may be made to immediately return fire, surrender or simulate other such behavior as is well-known within the art of training and evaluation. As is well-know in the art, a physical hit detection includes a weapon with a muzzle capable of firing live rounds, an accelerometer attached to the target or target support structure that senses when the round hits the target, and processing circuitry to record the event and transmit the signal for further processing.

As can be appreciated the weapon module 12 provides complete independence from a specific weapon and is particularly suited to a weapon that produces a recoil. The mountable feature and provision of freely portable detectors provide flexibility in designing the training and performance feedback environment. In its most common application, the present embodiment supports cost-effective law enforcement training by allowing the trainee's service weapon to be used during training and simulation. A further advantage of this novel approach is that the weapon module can be attached to virtually every gun used by law enforcement through commercially available mounts.

While preferred embodiments have been shown and described, various modifications and substitutions may be made thereto without departing from the spirit and scope of the present invention. Accordingly, it is to be understood that the present invention has been described by way of illustrations and not limitation.

Any element in a claim that does not explicitly state "means for" performing a specified function, or "step for" performing a specific function, is not to be interpreted as a "means" or "step" clause as specified in 35 U.S.C. 112 paragraph 6. In particular, the use of "step of" in the claims herein is not intended to invoke the provisions of 35 U.S.C. 112 paragraph 6.

What is claimed is:

1. An aiming and triggering detection system having a weapon with a bore and an infrared emitting diode emitting substantially non-coherent light that has a beam spread of about 70 inches at a range of 35 feet, substantially aligned with the weapon bore, a target, an infrared detector controller, and an infrared detector positioned within a zone of the target for determining whether the weapon is aimed within the zone of the target, or triggered within the zone of the target comprising:

a. recoil sensor responsive to triggering the weapon for sensing the triggering of the weapon;

b. an aiming-triggering mode selector having a seal-in control, the selector being responsive to the sensor for selecting either an aiming mode or a trigger mode, the seal-in control being initiated upon the triggering of the weapon;

c. a modulator having at least two distinctive output modulation signals for modulating the infrared emitting diode in at least two modes, the modulator being responsive to the aiming-triggering selector;

d. the infrared emitting diode having an aiming modulating mode for transmitting infrared output to the infrared detector, and a triggering modulating mode for transmitting infrared output to the infrared detector when the weapon has been triggered, the mode of the infrared emitting diode being controlled by the modulator;

e. the infrared detector sensitive to the wavelengths emitted by the infrared emitting diode when the light from the infrared emitting diode enters the detector, the detector being located within the zone of the target; and f. the infrared detector controller able to differentiate between the two modes of modulation detected by the infrared detector for outputting the mode of the weapon;

wherein the beam of light emitted from the 1RED is sufficiently spread such that the target, is able to detect that it is being covered when the weapon is aimed in the direction of the target and before the weapon is actually fired.

2. The aimpoint and trigger detection system of claim 1 wherein the sensor is a recoil sensor.

3. The aimpoint and trigger detection system of claim 1 wherein the selector comprises seal-in relay.

4. The aimpoint and trigger detection system of claim three wherein the seal-in relay is set from about 0.1 to 0.5 seconds.

5. The aimpoint and trigger detection system of claim three wherein the seal-in relay is set for about 0.25 seconds.

6. The aimpoint and trigger detection system of claim 1 wherein the IRED modulation frequencies are correlated to a particular weapon for identifying the trainee.

7. The aimpoint and trigger detection system of claim 1 comprising a lens positioned between the infrared emitting diode and the infrared detector, the lens for focusing the infrared beam.

8. The aimpoint and trigger detection system of claim 1 wherein the infrared detector is attached to the target.

9. The aimpoint and trigger detection system of claim 1 wherein the targets are moving targets.

10. The aimpoint and trigger detection system of claim 1 comprising an accelerometer for sensing when the target is hit by a round, a processing circuit to process the accelerometer output, and wherein the weapon includes a muzzle for firing the live round, whereby the system defines a dual live-fire and infrared detection system.

11. The aimpoint and trigger detection system of claim 1 further comprising a module having a mounting surface for attachment to a weapon mount, the module containing the infrared emitting diode, the modulator, the selector and the sensor.

12. The aimpoint and trigger detection system of claim 11 wherein the module further includes a power source for powering the IRED and the modulator.

* * * * *